US010247517B2

(12) United States Patent
Skrepetos

(10) Patent No.: US 10,247,517 B2
(45) **Date of Patent: *Apr. 2, 2019**

(54) SYSTEMS, METHODS, AND DEVICES FOR ELECTRONICALLY DISPLAYING INDIVIDUAL SHOTS FROM MULTIPLE SHOTS ON ONE PHYSICAL TARGET

(71) Applicant: Nicholas Chris Skrepetos, Eugene, OR (US)

(72) Inventor: Nicholas Chris Skrepetos, Eugene, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/707,073

(22) Filed: Sep. 18, 2017

(65) Prior Publication Data

US 2018/0031353 A1 Feb. 1, 2018

Related U.S. Application Data

(63) Continuation-in-part of application No. 14/054,072, filed on Oct. 15, 2013, now Pat. No. 9,829,286.

(60) Provisional application No. 61/714,661, filed on Oct. 16, 2012.

(51) Int. Cl.

| | |
|---|---|
| ***F41G 3/26*** | (2006.01) |
| ***F41G 3/28*** | (2006.01) |
| ***F41J 5/10*** | (2006.01) |

(52) U.S. Cl.

CPC ..... *F41G 3/2611* (2013.01); *F41G 3/28* (2013.01); *F41J 5/10* (2013.01)

(58) Field of Classification Search

CPC ..... F41G 3/2611; F41G 3/28

USPC ..... 434/16

See application file for complete search history.

(56) References Cited

U.S. PATENT DOCUMENTS

| | | | | |
|---|---|---|---|---|
| 6,739,873 | B1 * | 5/2004 | Rod | F41G 3/165 434/16 |
| 2003/0082502 | A1 * | 5/2003 | Stender | F41G 3/2611 434/23 |
| 2011/0053120 | A1 * | 3/2011 | Galanis | F41J 5/10 434/21 |
| 2011/0207089 | A1 * | 8/2011 | Lagettie | F41G 3/2611 434/22 |
| 2012/0258432 | A1 * | 10/2012 | Weissler | F41J 5/10 434/20 |
| 2013/0169820 | A1 * | 7/2013 | Stewart | H04N 5/225 348/169 |

* cited by examiner

*Primary Examiner* — Robert P Bullington
(74) *Attorney, Agent, or Firm* — Mohr Intellectual Property Law Solutions, PC

(57) ABSTRACT

Systems, methods, and devices for electronically displaying individual shots from multiple shots on one physical target including at least one camera directed at a physical target that is in data communication with a computer, the computer running software that allows for capture of successive images after each shot is taken, and isolation and highlighting of each shot from all other shots on the computer's display. In some examples, systems include the ability to generate and present overlays on the target images. In some further examples, systems include multiple cameras for capturing associated information with each shot such as shooter position, wind speed, and projectile speed.

18 Claims, 11 Drawing Sheets

SYSTEMS, METHODS, AND DEVICES FOR ELECTRONICALLY DISPLAYING INDIVIDUAL SHOTS FROM MULTIPLE SHOTS ON ONE PHYSICAL TARGET

CROSS REFERENCE TO RELATED APPLICATIONS

This application claims priority to copending U.S. application Ser. No. 14/054,072, filed on 15 Oct. 2013, which in turn, claims priority to U.S. Provisional Application Ser. No. 61/714,661, filed on 9 Jan. 2013. These applications are hereby incorporated by reference for all purposes.

FIELD OF THE INVENTION

The present disclosure relates generally to training systems for shooting sports. In particular, systems, methods, and devices used to track a series of successive shots from a shooter and correlate related information and images are disclosed.

BACKGROUND

Professional, recreational, and sport shooters often practice shooting rifles, side arms, pistols, pellet guns, airsoft guns, shotguns, archery and the like at shooting ranges or galleries. This practice, with live rounds in real weapons, cannot be adequately simulated by lasers, video games, or simulated shooting mechanisms. Common to these live round targeting systems is a paper target or paper bulls-eye target mounted at a predetermined distance from the shooter. The shooter will aim a firearm at the target and fire a round into the target. Commonly, multiple shots are fired into a single paper target. However, as the target becomes saturated with holes from each shot, the shooter has an increasingly difficult time determining the accuracy of the most recent shot. Thus, there is a need tor a system that enables each shot from a plurality of shots fired at a single physical target to be individually observed and, ideally, recorded so that the shooter can analyze his or her shooting pattern for improvement and correction.

Known systems and methods for shot tracking on physical targets are not entirely satisfactory for the range of applications in which they are employed. Downing, in U.S. Pat. No. 5,577,733 issued on 1996 Nov. 26, teaches a targeting system for a shooter of a gun. The system includes a target image created by a projector and projected on a target screen or pre-printed target. A light panel is disposed between the target and the gun so that a bullet from the gun passes through the light panel, which sends signals indicative of the bullet's location and velocity to a computer. However, one limitation of this system is that it requires a delicate and complicated light panel, which requires maintenance of the light-emitting sources, and can be easily damaged by stray ballets commonly found in a shooting gallery.

Another example of attempts to provide a shooter with an assessment of shots includes the teaching of Larkin et al. in U.S. Pat. No. 6,699,041 issued on 2004 Mar. 2. Larkin et al. discloses a self-assessing target with four quadrants wherein each quadrant contains possible causes for why shots ate straying from the intended center of the target. However, this system does not suggest, contemplate, motivate, or teach a system for providing a single target with an electronic image that masks previous shots.

A more modern approach to targeting imagery includes the teaching of Mowers in U.S. Pat. No. 7,255,035 issued on 2007 Aug. 14. Mowers discloses a weaponry camera sight with a digital electronic display of the sight picture for the shooter. The display magnifies the sight picture, thus eliminating a scope sight. The display includes a range finding device and can record the screen image for later playback. However, Mowers does not contemplate, suggest, motivate, or teach a system for providing a single target with an electronic image that masks previous shots.

A more modern approach to a firearm training system includes the teaching of Kendir et al. in U.S. Pat. No. 7,329,127 issued 2008 Feb. 12. Kendir et al. discloses a laser training system including a target assembly, a laser transmitter assembly that attaches to a firearm, a detection device and a processor. A target locates at extended ranges and accounts for various environmental and other conditions. One limitation of the Kendir et al. system is that the laser replaces live rounds, this detracting from the real-world feel of using ammunition. Further, Kendir et al. does not contemplate, suggest, motivate, or teach a system for providing a single target with an electronic image that masks previous shots.

Yet another attempt to provide a system to provide improved feedback to a shooter of his or her shots is the Target-Cam system (www.target-cam.com), currently available on-line. This system includes a camera and portable wireless digital spotting scope for target shooting and rifle and handgun sighting. The Target-Cam systems use a wireless video camera and a hand-held 3.5" color display that allows target shooters to view every target hit instantly from up to 300 yards away. However, this system does not contemplate, suggest, motivate, or teach a system for providing a single target with an electronic image that masks previous shots, nor does it provide a computer with software capable of analyzing shots.

Thus, there exists a need for systems and methods for electronically displaying individual shots from multiple shots on one physical target that improve upon and advance the design of known shot marking and tracking systems and methods. Examples of new and useful systems, methods and devices for electronically displaying individual shots from multiple shots on one physical target relevant to the needs existing in the field are discussed below.

SUMMARY

The present disclosure is directed to computer system, software, at least one camera, and an imaging system adapted to show an image of a physical bulls-eye target. The system is configured to display an image highlighting the most recent shot taken, even where the most recent shot is one of a plurality of shots already physically present in the physical bulls-eye target. The system can also be configured to capture a second image of the shooter taking the shot, allowing a conflation of the shooter's stance and technique with each shot for training or certification purposes. The system further can be configured to capture additional shot-related information such as down-range wind speed and/or chronograph readings of the muzzle or down-range velocity of each shot.

By capturing a series of images for each successive shot taken, starting with an initial image of a clean target, the disclosed system can either alternate between captured images or utilize portions of one or more successive images to digitally remove previous shots, thereby allowing a single shot to be isolated from a group of shots and appear alone on an otherwise clean representation of the target.

Furthermore, the disclosed system can also be used to manipulate captured images of the target, such as correcting for camera placement that is off-axis from the target, superimposing overlays upon images of a target, such as a target grid, silhouettes of game or other possible subjects, or additional information from various sensors such as a chronograph and/or wind meter, determining shot grouping measurements, and other automatic or automated processing techniques. Enabling these digital manipulations of a captured target image offers substantial and heretofore unrealized advantages over the prior art, and offers options that cannot be realized with conventional methods involving the manual marking and swapping of paper targets.

DETAILED DESCRIPTION

Figure 1:
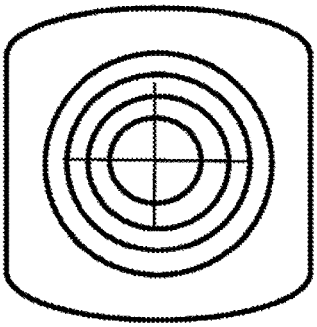
FIG. 1 is a representation of a physical target prior to being hit with ammunition according to a first preferred embodiment of the present invention.
Figure 2:
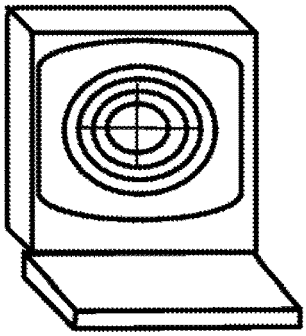
FIG. 2 is a representation of a computer and software of the embodiment of FIG. 1 and shows a screen image of the physical target prior to being hit with ammunition.
Figure 3:
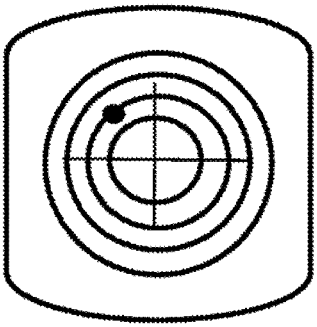
FIG. 3 is a target of FIG. 1 after being hit with a first round.
Figure 4:
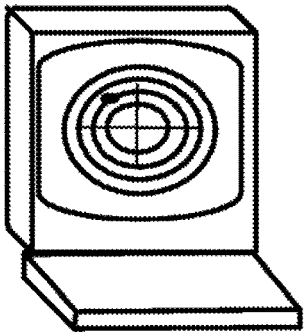
FIG. 4 is the screen image displayed on the computer using the software of the present invention and corresponds to the physical shot of FIG. 3.

The disclosed systems, methods and devices for electronically displaying individual shots from multiple shots on one physical target will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various systems, methods and devices for electronically displaying individual shots from multiple shots on one physical target are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

The following disclosure includes definitions of selected terms used. The definitions include various examples and/or forms of components that fall within the scope of a particular term and can be used to implement the disclosed methods. The examples are not intended to be limiting and both singular and plural forms of terms may be within the definitions.

As used in this application, the term "computing unit" refers to a computer-related entity, hardware, firmware, software, a combination, thereof, or software in execution. For example, a computing unit can be, but is not limited to being, a process running on processor unit, a processor, an object, an executable, a thread of execution, a program, and a computer. By way of illustration, both an application running on a server and the server can be computing units. One or more computing units can reside within a process and/or thread of execution and a computing unit can be localized on one computer and/or distributed between two or more computers.

The term "system memory," as used herein, refers to a medium that participates directly or indirectly to provide signals, instructions and/or data. A system memory may take forms, including, but not limited to, non-volatile media, and volatile media. Non-volatile media may include, for example, optical or magnetic disks, read-only memory (ROM), flash memory including flash drives and solid state disks, and so on. Volatile media may include, for example, dynamic memory, random-access memory (RAM), cache memory, and the like. Common forms of a system memory include a computer-readable medium such as, but not limited to, a floppy disk, a flexible disk, a hard disk, a magnetic tape, other magnetic medium, a CD-ROM, other optical medium, punch cards, paper tape, other physical medium with patterns of holes, a RAM, a ROM, an EPROM, a FLASH-EPROM, or other memory chip or card, a memory stick, and other media from which a computer, a processor or other electronic device can read.

The term "shared data storage," as used herein, refers to a physical and/or logical entity that can store data. Data storage, may be, for example, a database, a table, a file, a list, a queue, a heap, a memory, a register, a file directory, a storage location, and so on. Data storage may reside in one logical and/or physical entity and/or may be distributed between two or more logical and/or physical entities.

The term "logic," as used herein, includes but is not limited to hardware, firmware, software and/or combinations of each to perform a function(s) or an action(s), and/or to cause and execute a function or action from another logic, method, and/or system. For example, based on a desired application or needs, logic may include a software controlled microprocessor, discrete logic like an application specific integrated circuit (ASIC), a programmed logic device like a field programmable gate array (FPGA), a memory device containing instructions, combinations of logic devices, or the like. Logic may include one or more gates, combinations of gates, or other circuit components. Logic may also be fully embodied as software, or may be a computing unit as defined herein. Where multiple logical logics are described, it may be possible to incorporate the multiple logical logics into one physical logic. Similarly, where a single logical logic is described, it may be possible to distribute that single logical logic between multiple physical logics.

The term "software," as used herein includes, but is not limited to, one or more computer or processor instructions that can be read, interpreted, compiled, and/or executed and that cause a computer, processor, or other electronic device to perform functions, actions and/or behave in a desired manner. The instructions may be embodied in various forms like routines, algorithms, feature sets, methods, threads, and/or programs including separate applications or code from dynamically linked libraries. Software may also be implemented in a variety of executable and/of loadable forms including, but not limited to, a stand-alone program, a function call (local and/or remote), a servlet, an applet, instructions stored in a memory, part of an operating system or other types of executable instructions. It will be appreciated by one of ordinary skill in the art that the form of software may be dependent on, for example, requirements of a desired application, the environment in which it runs, and/or the desires of a designer/programmer or the like. It will also be appreciated that computer-readable and/or executable instructions can be located in one logic and/or distributed between two or more communicating, co-operating, and/or parallel processing logics and thus can be loaded and/or executed in serial, parallel, massively parallel and other manners.

Suitable software for implementing the various components of the example systems ad methods described herein include programming languages and tools like Java, Pascal, C#, C++, C, CGI, Perl, PHP, SQL, APIs, SDKs, assembly, firmware, microcode, and/or other languages and tools. Software, whether an entire system or a component of a system, may be embodied as an article of manufacture and maintained or provided as part of a computer-readable memory as indicated previously. Another form of the software may include signals that transmit program code oi the software to a recipient over a network or other communication medium. Thus, in one example, a computer-readable medium has a form of signals that represent the software/firmware as it is downloaded from a web server to a user. In another example, the computer-readable medium has a form of the software/firmware as it is maintained on the web server. Other forms may also be used.

The term "user," as used herein, includes but is not limited to one or more persons, software, computers or other devices, or combinations of these. A user may also be a real person that is an individual, or is part of a group, organization, company, team or other arrangement of people whether formed formally in a legal entity or otherwise.

In one preferred embodiment, the present invention contemplates a software tool to be run on a computer system that has at least one user, but preferably a plurality of users. The software is designed to enable an organization, team, group, or individual to manage disparate processes with an over-riding feature of linking and executing strategic plans and budgets to activities within the scheme of the end-to-end process and specific tasks and subtasks to be performed by unique individuals, teams, or groups within the organization. The software tool, recognizing that any individual user will have a unique experience and comfort level with the software tool, further is configured to enable user-customizable business rules, terminology, templates, and user interfaces. This allows for the individual or organization to tailor the software to suit their business needs and increases the adoption (acceptance rate by users is increased). Further, real-time presentation of data enables the system to create a flexible table that adjusts to the user input in real-time.

Various examples of the present invention may be implemented using electronic circuitry (not shown) configured to perform one or more functions. For example, with some embodiments of the invention, the online method may be implemented using one or more ASICs. More typically, however, components of various examples of the invention will be implemented using a programmable computing device or computer 800 executing firmware or software instructions, or by some combination of purpose-specific electronic circuitry, and firmware or software instructions executing on a programmable computing device or computer.

Figure 16:
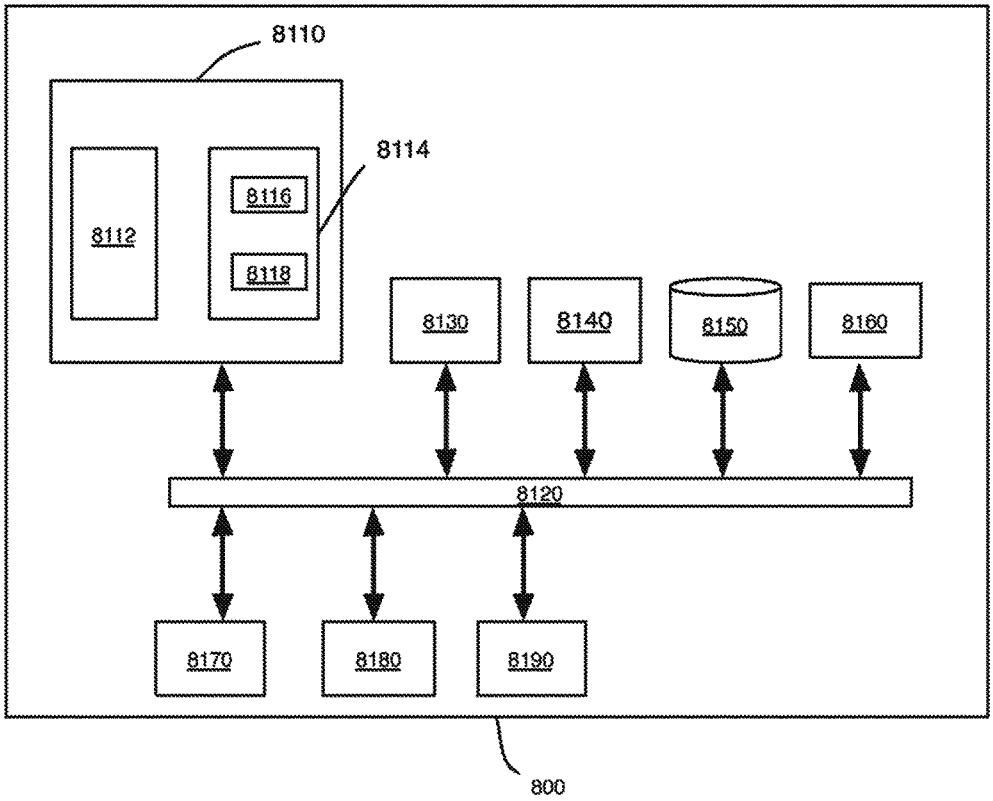
FIG. 16 is a schematic diagram of a computer system configured to run a software device according to the present invention.

Accordingly, FIG. 16 shows one illustrative example of a computer 800 that can be used to implement various embodiments of the invention. The computer 800 may be incorporated within a variety of electronic devices, such as personal computers, desktop computers, servers, tablet computers, cellular phones, smart phones, personal data assistants, global positioning system devices, and the like.

As seen in FIG. 16, computer 800 has a computing unit 8110. Computing unit 8110 typically includes a processor or processing unit 8112 and a system memory 8114. Processing unit 8112 may be any type of processing device for executing software instructions, but will conventionally be a microprocessor device. System memory 8114 may include both a read-only memory (ROM) 8116 and a random-access memory (RAM) 8118. As will be appreciated by those of ordinary skill in the art, both read-only memory (ROM) 8116 and random access memory (RAM) 8118 may store software instructions to be executed by processing unit 8112.

Processing unit 8112 and system memory 8114 are connected, either directly or indirectly, through a bus 8120 or alternate communication structure to one or more peripheral devices. For example, processing unit 8112 or system memory 8114 may be directly or indirectly connected to additional memory storage, such as a removable magnetic disk drive 8140, a hard disk drive 8150, a flash memory card 8160, and a removable optical disk drive 8170. Processing unit 8112 and system memory 8114 also may be directly or indirectly connected to one or more input devices 8180 and one or more output devices 8190. Input devices 8180 may include, for example, a keyboard, touch screen, a remote control pad, a pointing device (such as a mouse, touchpad, stylus, trackball, or joystick), a scanner, a camera or a microphone. Output devices 8190 may include, for example, a monitor display, an integrated display, television, printer, stereo, and/or speakers.

Still further, computing unit 8110 will be directly or indirectly connected to one or more network interfaces 8130 for communicating with a network. This type of network interface 8130, also sometimes referred to as a network adapter or network interface card (NIC), translates data and control signals from computing unit 8110 into network messages per one or more communication protocols, such as the Transmission Control Protocol (TCP), the Internet Protocol (IP), and the User Datagram Protocol (UDP). These protocols are well known in the art, and thus will not be discussed here in more detail. An interface 8130 may employ any suitable connection agent for connecting to a network, including, for example, a wireless transceiver, a power line adapter, a modem, or an Ethernet connection.

It should be appreciated that, in addition to the input, output and storage peripheral devices specifically listed above, the computer 800 may be connected to a variety of other peripheral devices, hiding some that may perform input, output and storage functions, or some combination thereof.

Computer 800 may be connected to or otherwise include one or more other peripheral devices, such as a telephone (not shown). The telephone may be, for example, a wireless "smart phone," such as iPhone® or Droid® brand smart phones. As known in the art, this type of telephone communicates through a wireless network using radio frequency transmissions. In addition to simple communication functionality, a "smart phone" may also provide a user with one or more data management functions, such as sending, receiving and viewing electronic messages (e.g., electronic mail messages, SMS text messages, etc.), recording or playing back sound files, recording or playing back image files (e.g., still picture or moving video image files), viewing and editing files with text (e.g., Microsoft Word or Excel files, or Adobe Acrobat files), etc. Because of the data management capability of this type of telephone, a user may connect the telephone with computer 800 so that their data may be synchronized.

Of course, still other peripheral devices may be included with or otherwise connected to a computer 800 of the type illustrated in FIG. 16, as is well known in the art. In some cases, a peripheral device may be permanently or semi-permanently connected to computing unit 8110. For example, with many computers, computing unit 8110, hard disk drive 8150, removable optical disk drive 8170, and a display (not shown) are semi-permanently encased in a single housing.

Still other peripheral devices may be in operable communication with, and operable connection to the computer 800. Computer 800 may include, for example, one or more communication ports (not shown) through which a peripheral device can be connected to computing unit 8110, either directly or indirectly through bus 8120. These communication ports may thus include a parallel bus port or a serial bus port, such as a serial bus port using the Universal Serial Bus (USB) standard or the IEEE 1394 High Speed Serial Bus standard (e.g., a Firewire port). Alternately or additionally, computer 800 may include a wireless data "port," such as a Bluetooth® interface, a Wi-Fi interface, an infrared data port, or the like.

It should be appreciated that a computer 800 may include more components than computer 800 illustrated in FIG. 16, fewer components than computer 800, or a different combination of components than computer 800. Some implementations of the invention, for example, may employ one or more computers 800 that are intended to have a very specific functionality, such as a smart phone or server computer. These computing devices mat thus omit unnecessary peripherals, such as the network interface 8130, removable optical disk drive 8140, printers, scanners, external hard drives, etc. Some implementations of the invention may alternately or additionally employ computers 800 that are intended to be capable of a wide variety of functions, such as a desktop or laptop personal computer. These computers 800 may have any combination of peripheral devices or additional components as desired.

For purposes of explaining the contemplated software tool and method of the various preferred embodiments, a conceptual feature set is used herein as a means for explaining the function and construct of the software, but should not be used as a literal, limiting construct of software development. Broadly, "feature set," as used herein, refers generally to describing the functionality of the software tool in discrete, possibly independent, feature sets as a way to describe aspects of the present invention. Conceptually, feature sets represent a separation of concerns or functions to achieve a result or to transform data or data-elements. Concerns or functions are separated (at least conceptually) so that feature sets perform logically discrete functions or operations or steps. Feature sets may interact with other feature sets of the system or may be highly independent from other feature sets. Conceptually, a feature set can operate independently to another feature set, or can use output from another feature set to trigger a particular feature set to operate. At least one feature set, or as contemplated conceptually herein, several feature sets cooperating and/or operating autonomously compile to construct the executable application program of the software tool of the present invention.

The present invention, as appreciated by those having ordinary skill in the art, can be represented in many different computer-readable languages, including, but not limited to Ada, Algol, BlitzMax, COBOL, Component Pascal, D, Erlang, F, Fortran, Haskell, IBM/360 Assembler, IBM RPG, Java, C++, and others, for example.

Figure 9:
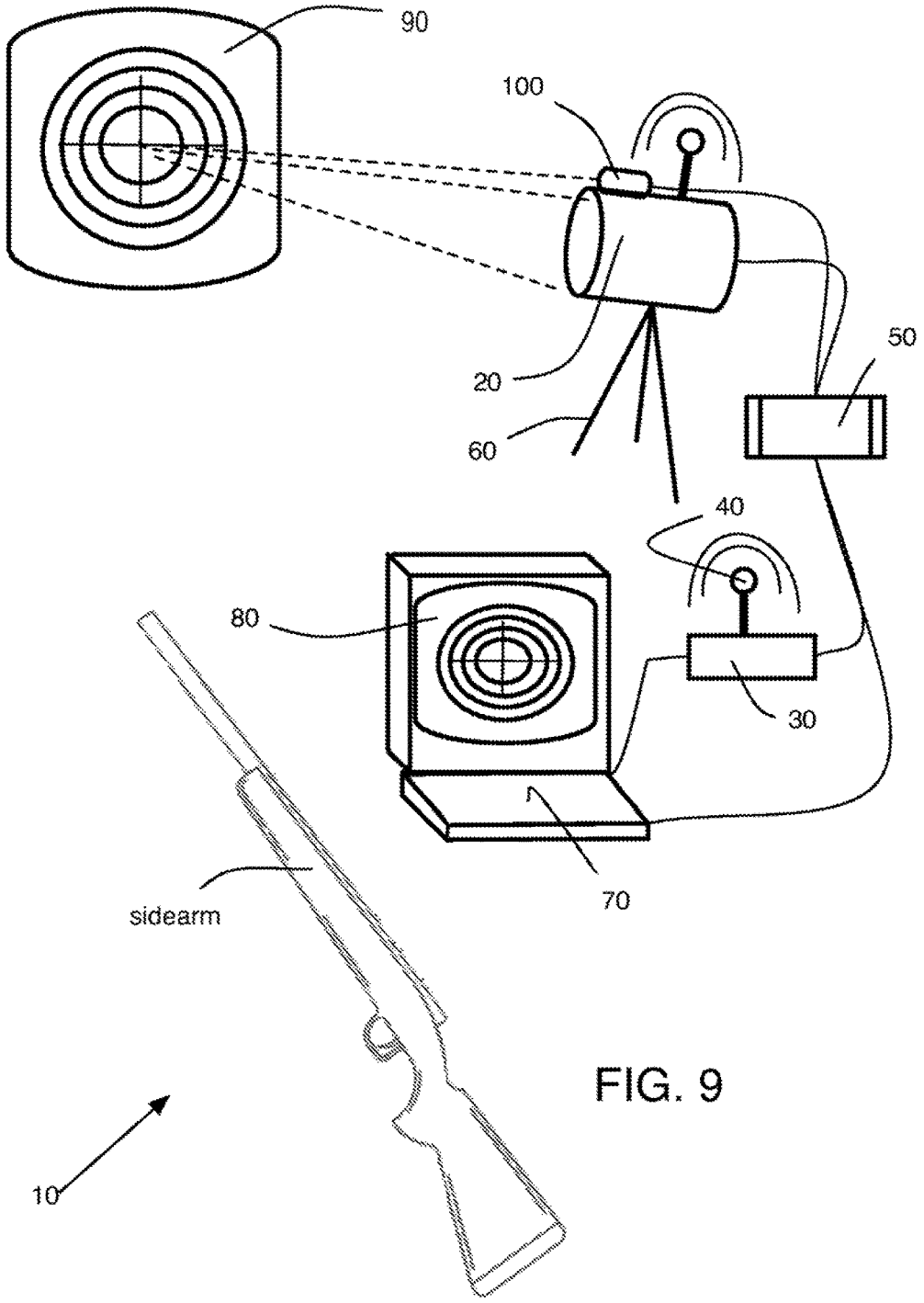
FIG. 9 is a schematic diagram of the system according to a first embodiment of the present invention.

In one preferred embodiment depicted in FIG. 9, system 10 includes one or more cameras 20, router 30, antenna 40, portable power source (battery) 50, tripod 60, and a computer 70 having specific software 80. The system also includes a booster and, optionally, a YAGI antenna for relaying data over 1-mile, for example. At least one camera 20 is aimed at a target 90. The system can optionally include a light for night shooting, and an alignment device 100 attached to camera 20. System 10 improves over the existing art because no modification to the shooter's firearm is needed to work with system 10, meaning that the shooter can use system 10 with any of his or her own weapons. Also, system 10, once set up, allows the shooter to select and swap which weapons are used for practice. Other benefits include providing a data file by software 80 that can be reviewed at a later date or time for purposes of certification or training. System 10 can be configured to work in real time so that the shooter can monitor his or her shots as they are taken and adjust the firearm and/or his or her shooting style.

Camera 20 can be implemented using any suitable camera technology and system now known or later developed. Examples of such camera technology and systems that are known in the an include cameras that use solid state imaging devices such as CCD and CMOS, older tube-based camera imagers, or other, newer technologies. Camera 20 preferably outputs still images in a known format such as JPEG, GIF, PNG, DNG, or other standard format well-known in the field; other cameras may output a proprietary format such as RAW that can be specific to the camera and/or system, and that may require additional software for translation. Such images can be transmitted over WiFi, via a wired connection such as USB or Ethernet, or any otter suitable method tor transmitting digital images.

In other embodiments, camera 20 can output a digital video stream that can be transmitted over WiFi or wired connections such as HDMI, IEEE-1394/Firewire, SDI, HDSDI, or other suitable digital video transmission format now known or later developed. Such digital video streams may be in H.264, MPEG-2, MPEG-4, or another suitable video stream format now known or later developed. When camera 20 is implemented as a video camera, system 10 may extract frames from the video stream for capturing still images as detailed below. Additionally, where camera 20 provides a video stream, system 10 may be configured to allow live video view of target 90 for ease of correctly aligning camera 20 with target 90. Still other embodiments of camera 20 may offer both still image capture as well as streaming digital video. Suitable cameras may include "action cams" such as the GoPro® line of cameras and similar offerings by Nikon and Sony, a point and shoot style still camera, a single-lens reflex camera such as a Nikon D800 or Canon 5D, a dedicated video camera such as those offered by JVC and Panasonic, or any other still or video camera in a suitable package that provides a compatible output and controllability by software 80.

Router 30 and associated antenna 40 are preferably a readily available WiFi-compatible router such as is available from Linksys, Cisco, Netgear, or Belkin, or from any other company manufacturing a similar product. Router 30 can implement WiFi as is well-known in the industry using 2.4 GHz or 5 GHz bands and protocols such as 802.11g, 802.11n, 802.11ac, or another similarly suitable wireless networking protocol that is now known or later developed. Router 30 may also or alternatively implement a wired networking protocol, such as Ethernet, or could be implemented as a hub for a system bus such as USB, FireWire/IEEE-1394, Thunderbolt, or other similarly suitable device communications protocol.

In some implementations, antenna 40 is integrated into router 30, while in other implementations antenna 40 may be detachable, allowing a custom implementation of antenna 40 that is can be tailored to a particular environment. For example, while most antennas integrated into router 30 are of an omnidirectional type, in some environments it may be more preferable to use one or more antennas 40 that are directional, allowing for a stronger signal at greater distances, directed to computer 70 and/or camera 20. The implementation of these various types of antennas is well-known in the art.

Power source 50 can be implemented using any technology that can suitably meet the power requirement of one, some, or all components of system 10. In some cases, power source 50 may be implemented with multiple sources or may be integrated into each individual component of system 10, where camera 20 may have its own dedicated battery pack, computer 70 may have its own dedicated battery, such as when computer 70 is a laptop or tablet, and router 30 is equipped or powered by its own power source 50. In other implementations, router 30 may be capable of being powered via computer 70 over a wired connection, such as USB, in which case computer 70 doubles as power source 50 for router 30.

In a preferred embodiment power source 50 is one or more batteries optionally coupled to a power converter/inverter, depending on the needs of the components of system 10. Such batteries can be of any suitable type now known or later developed, such as rechargeable technologies like lead-acid, lithium-ion, lithium-polymer, nickel metal-hydride, nickel-cadmium, or other similarly suitable battery type, or non-rechargeable battery types including alkaline, carbon-zinc, lithium, or other similarly suitable types. Power source 50 in some cases may simply be wall power, such as a socket and/or power strip. In other cases, power source 50 could be a portable generator, such as any of the gas-powered generators available for Honda, Yamaha, Generac, or other companies. Regardless of the way in which power source 50 is implemented, additional circuitry may be necessary to meet varying power requirements of the components of system 10, such as inverters or power converters. In some cases, the components of system 10 may have differing power requirements such as different voltage and current draws, which power source 50 must accommodate. In still other cases, various components of system 10 may include their own power converter circuitry, such as when power source 50 provides standard household current of 110/120/220/240VAC, depending upon region.

Those skilled in the art will appreciate that computer 70 need not be near camera 20. Camera 20, router 30 and computer 70 can be dispersed over several physical locations. For example, computer 70 may be positioned adjacent to the shooter, a first camera 20 may be placed near the target, a second camera 20 may be placed behind the shooter, and router 30 may be placed in a location that provides either cabled or wireless signals from each camera 20 and relays, and/or processes those signals then transfers a new signal, to computer 70. Alternatively, some components may be combined, e.g. computer 70 could act as a WiFi hub and each camera 20 could be likewise equipped with WiFi, eliminating fee need for a discrete router 30 and antenna 40; where computer 70 and cameras 20 each have their own battery packs, discrete power source 50 can also be eliminated.

Tripod 60 can be implemented using any suitable means to support camera 20 in an immobile fashion, including a tripod commonly used for photography, clamps, cables, bands, adhesives or any other suitable device. In some cases, tripod 60 may be integrated into camera 20.

Target 90 is a physical target as is well known and used in the shooting sports, and can be an NRA-standard bullseye, scope sighting target, paper with a printed silhouette, or even just a blank sheet of paper, cardboard, plastic, or other suitable material. It will be understood that the disclosed system is intended for use with targets that retain a persistent hole from a shot, as opposed to some kinetic targets such as metal silhouettes that are designed to absorb a bullet impact without significant lasting damage.

In one preferred embodiment, system 10 includes a FOSCAM brand and model no. FI8905W outdoor camera available from www.focsm.us, an EZOPower brand and model number 7800MAH DUAL USB Rechargeable Battery Pack available from mwave.com, a CNETUSA brand and model no. CQR-980 Router available from cnetusa.com, a 9DBI Antenna Added to Router, a Sunpak brand and model no. 5200D Tripod available, a 5V Charger for Battery Pack, a USB->3.5 MM Barrel Connector Wire for Camera Power, a USB->MiniUSB Connector Wire for Router Power, a toolbox that contains the product and that has foam inserts where all components are stored except for the Camera, Tripod and USB Drive, and a USB Drive with software 80 on it. Many of these components are easily obtainable from a myriad of on-line suppliers as would be generally understood in the art.

In one preferred embodiment, computer 70 is a Windows based laptop, but in other embodiments a Mac-based operating system is supported, as are applications for smartphones and tablets including the iPhone, iPad and Android Tablets, for example. A person skilled in the art will recognize that these are merely suggestions; computer 70 can be implemented as outlined above with reference to FIG. 16, and can include other commercially or publicly available operating systems, or can be implemented using custom purpose-built hardware and custom software. In still other implementations, the functionality of computer 70 can be integrated into one or more of the other components of system 10.

Once the physical components of the system are set up, computer 70 and software 80 direct the user to focus camera 20 on the physical target 90. The user is prompted to capture an image of target 90 before any shots are fired. Then, the user takes his or her shooting position and initiates a shot-capture mode of software 80. The most recent (current) shot can be indicated on the computer screen by blinking a first color and/or image of what changed on the target—such as, for example, the actual bullet image or impression made by the bullet, or in some other way visually highlighting the shot.

Alignment device 100 is preferably attached to camera 20 to facilitate positioning camera 20 at target 90, so software 80 can correctly capture at least the needed portion of target 90, without requiring a user to repeatedly return to computer 70 to view a series of test images. Alignment device 100, as a device and as a means for alignment of camera 20, can be implemented using a variety of mechanisms, such as an optical scope that approximates the angle and field of view of camera 20. A user viewing target 90 through the scope can rely upon the view to assure that camera 20 would capture a comparable view of target 90. Another implementation of alignment device 100 uses a laser, which could present as a dot showing the approximate center of camera 20's field of view. A laser showing a single dot would be particularly useful where the general angle of view of camera 20 is known, and the user has prior knowledge of the correct distance from target 90 to place camera 20. Alternatively, a laser for alignment device 100 could be configured to project a frame that approximate the area of view of camera 20, thus allowing a user to correctly center and distance camera 20 from target 90 without price knowledge of appropriate placement. Another possible implementation of alignment device 100 uses a small video screen attached to camera 20 that receives a video or image feed from camera 20, allowing the user to see the actual field of view of camera 20 during positioning. Still other implementations of alignment device 100 may use a light projector to approximate camera 20's field of view. Alignment device 100 could further be implemented using any other technology, device, or other suitable implement that allows for reliable placement of camera 20 relative to target 90 without the need for repeated capture of images, or for enabling a live video feed from camera 20 on computer 70, if camera 20 includes such capability. Where system 10 has multiple cameras 20, each camera can be equipped with a suitable alignment device 100.

System 10 is configured so that the user can digitally mark/label/color-code on the target depiction on computer 70 of each shot placed on physical target 90, enabling each individual shot to be readily identified by a myriad of characteristics, including the name of the individual that made the shot, the time of day, date, and other indicia, for example. Software 80 can be configured to tag images with these characteristics, and then allow a user to search or scroll through images sorted by the characteristics and other various similar or related criteria. This enables multiple uses and/or users of a single physical paper target 90, which will be described in greater detail herein.

Another key feature is the ability to digitally alternate screen views between two of more images to give the viewer hew information by rapidly altering a more recent image with a previous image so that the new matter (i.e. the location of a bullet hole on a target from a new shot fired at the target) "stands out" to the viewer. Alternatively or additionally, software 80 can use the previously captured shot images, including the original picture of a clean target, to digitally erase previous shots so that each successive shot appears by itself on an otherwise clean depiction of target 90. Such image manipulation techniques are known in the industry, and can include copying portions of the initial clean target image that correspond to the location of each tagged shot to effectively cover or "repair" the shots, giving the appearance of a clean target, or other image healing techniques that can use surrounding image area to simulate the appearance of a clean target.

Figure 5:
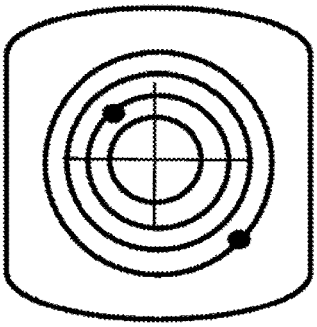
FIG. 5 shows a second shot on the physical target of FIG. 1.
Figure 6:
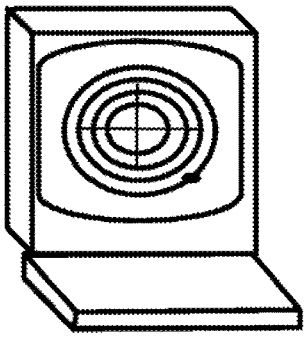
FIG. 6 is the screen image displayed on the computer using the software of the present invention and corresponds to the physical shot of FIG. 5.
Figure 7:
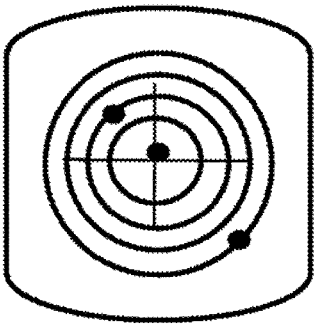
FIG. 7 shows a third shot on the physical target of FIG. 1.
Figure 8:
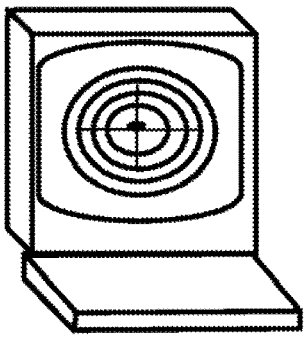
FIG. 8 is the screen image displayed on the computer using the software of the present invention and corresponds to the physical shot of FIG. 7.

FIGS. 1-8 show the results of such digital manipulation. Starting with FIG. 1, a clean target 90 is presented and imaged, resulting in its corresponding depiction on computer 70 in FIG. 2. A user takes a first shot, shown on target 90) in FIG. 3 and it corresponding depiction in FIG. 4. FIG. 5 shows target 90 following the user taking a second shot, with two holes clearly visible. Once the user has marked the first shot, software 80 then can, for example, copy the portion of the image of FIG. 2 corresponding to the location of the first shot in FIG. 4 to cover the first shot, thereby isolating the second shot. This result is visible in FIG. 6, where the target depiction shows only the second shot, but not the first. Likewise, FIG. 7 shows target 90 after the user takes a third shot, and FIG. 8 shows that third shot in isolation on the target depiction, with both the first and second shots masked using portions of FIG. 2. With such manipulation, it will be appreciated that each previous shot need not be covered, and further, software 80 can enable selective covering and uncovering of shots, e.g. designating that a particular grouping of shots be displayed simultaneously while selectively covering other shots not related to the desired grouping.

In addition to color-coding each shot, the user can tag each shot with the firearm, ammunition, time/date and other details that will be important to shooters. Software 80 allows the user/shooter to enter all relevant information including the location of the shooting, the target distance, type of firearm, ammunition used, etc.

After shooting a shot at physical target 90, the user then inputs (via button click, remote button, mouse, voice-command, touch screen interface or otherwise) to the computer to inform software 80 that the shot has been taken. Then, software 80 either alternates between the previous captured image and the current captured image, which "shows" the shot (the difference in the image) blinking, or digitally accomplishes a similar result by using the appropriate portion of the initial image of a clean target 90 to repeatedly mask and unmask the shot. Software 80 can distinguish different shots enabling the user to input data relating to the shot after each shot. For example, the user can use the mouse or a touch interface to mark (tag and/or color) the hole that is blinking and associate who the shooter was, what type of weapon, type of ammunition, location, date, etc. Software 80 also allows for electronic zoom, cropping, saving, etc., as well as exporting the images to post in community blogs or to save (i.e. .jpg or .png formatted files) for any other purpose. For example, military and law enforcement officers may want to save their target shooting profile to serve as evidence for their yearly qualification certification.

Figure 11:
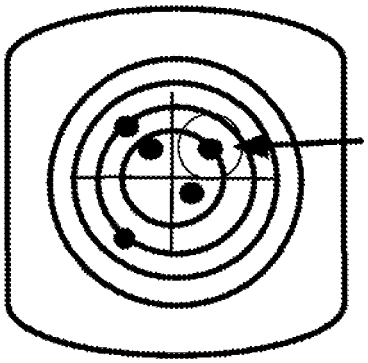
FIG. 11 is a front view of a physical target with the most recent shot taken by a user indicated by the circle and arrow.
Figure 12:
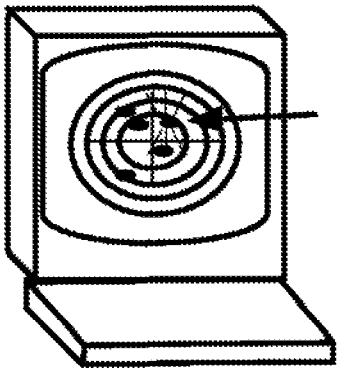
FIG. 12 is a perspective view of a screen image of the target depicted in FIG. 11 as presented by the embodiment of the system of FIG. 9, showing the most recent shot taken by the user highlighted by flashing.

In another embodiment, as FIGS. 11 and 12 illustrate, software 80 is configured to allow the user to select displaying the most recent shot as a blinking or flashing icon, or an image of the actual shot showing the target and the impression or bullet embedded in the target, on the screen with a representation of target 90 in the background and each previous shot also being displayed. In FIGS. 11 and 12, a lead-arrow points out the most recent shot on the physical target (FIG. 11) in a grouping of previous shots. In FIG. 12, software 80 highlights this most recent shot by flashing or blinking the bullet icon on the target. The user can then tag the blinking shot by clicking on the mouse, touching the shot where computer 70 is equipped with a touch screen or similar device, or otherwise using another appropriate input device, and then associate any characteristic with that shot (e.g. person's name, weapon, ammunition, etc., as previously discussed). Following tagging, system 10 will be ready to capture the next shot, converting the just tagged shot to a non-blinking icon, with the process iteratively repeated for each subsequent shot. As mentioned above, software 80 can alternatively or additionally be configured to visually highlight the most recent shot in a different fashion than blinking, e.g. painting it a different color, circling it, generating an arrow pointing to it, or another similarly suitable visual designation technique.

Software 80 can be configured to display any combination or subset of previously captured shots. For example, a user may wish to display the last n-shots. Or, the user may wish to show all shots fired by a particular firearm using a particular ammunition type. For multiple shooters, the user may wish to see all of shooter #1's shots, and so on.

Figure 10:
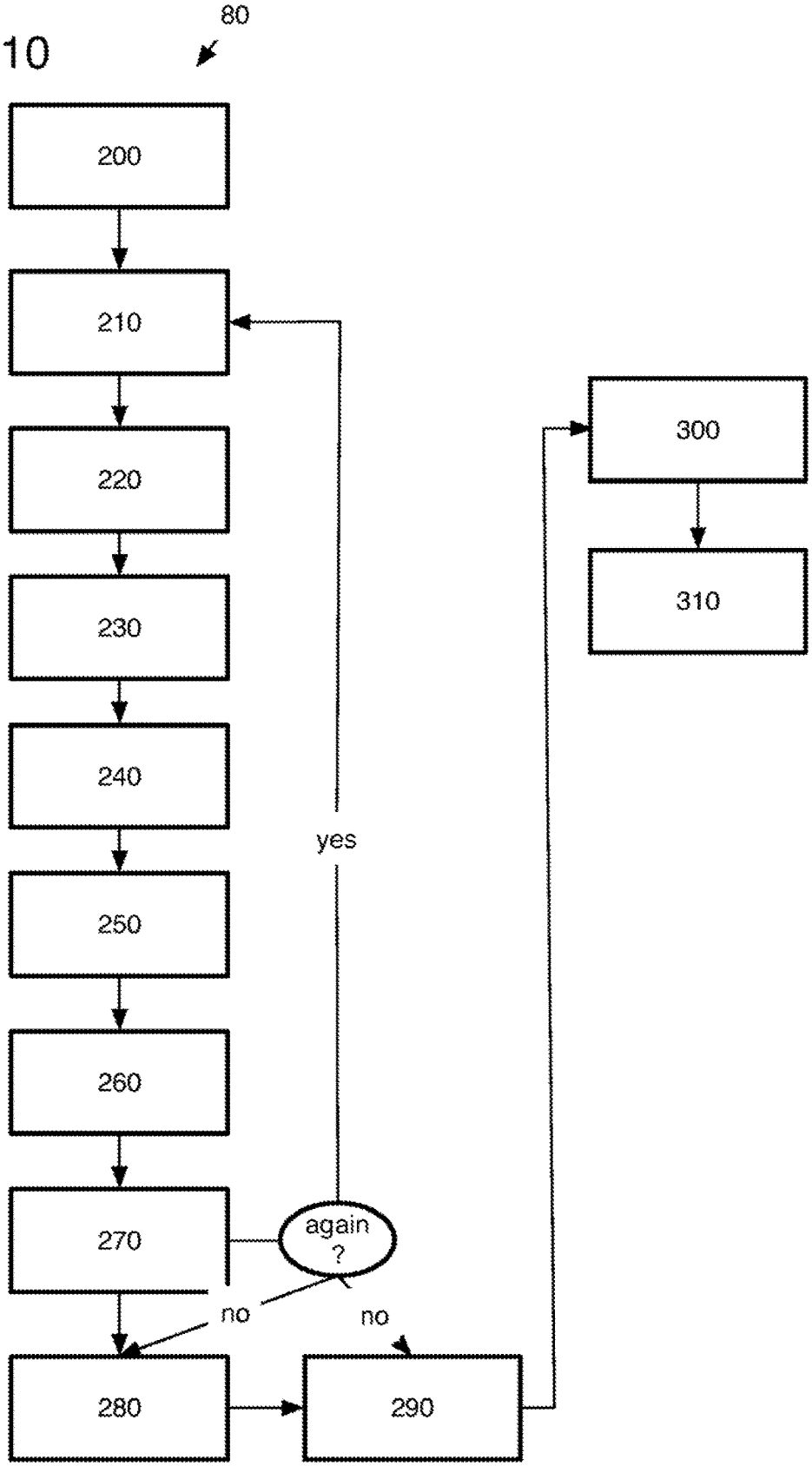
FIG. 10 is a block diagram of the steps of operation of the first embodiment of the system depicted in FIG. 9.

In one possible method for operating the preferred embodiment of FIG. 9, as detailed in FIG. 10, software 80 is resident on a host computer 70 and comprises a series of executable steps and manipulates data input by a user and renders a screen image based on input from a camera. Once software 80 is in execution on computer 70 (block 200), a user sets up camera 20 to view a physical target and then triggers software 80 via an input device associated with computer 70 to capture an image of target 90 (block 210) prior to any shots being fired. Next, the user inputs any optional information related to the user's name, location of the shoot, distance to target 90, firearm used, ammunition used, and any other pertinent information (block 220).

Next, the user fires his or hex firearm (one shot) at target 90 and then inputs (block 230) to computer 70 by any one of several means for inputting to computer 80 including, but not limited to, verbal command, mouse click, keystroke, hand gesture, touch screen tap, remote button actuation, or other similar input as would be well understood in the art. This triggers camera 20 to capture a second image (block 240) and send data representing the image to software 80 via computer 70. Software 80 stores this data (block 250) and displays an image over the static target image (block 260). At this point the user has the option to select a color or to tag (block 270) the shot with any identification information that is relevant. This allows the user to switch firearms, or for multiple users to take shots at the same physical target.

At this point, software 80 has a first image of target 90 prior to any shots being fired at target 90, and a second image of target 90 with at least one shot hole. This second image can be used for displaying, for example, the most recent shot fired, as this second image includes an actual image of the target with the impression/hole made by the round or bullet in the target. By alternating the display of computer 70 between the first image and a second image, or by any second image from a plurality of images, or moving through captured images in sequential or non-sequential order, the shooter can see on the display a history of all shots taken and their placement. For example, a shooter may be interested in a grouping of multiple shots fired from firearm 1 to compare to a grouping of shots fired from firearm 2. Alternatively, shooter 1 may want to compare a grouping of shots relative to a second grouping of shots fired by shooter 2, or shooter 1 may just wish to see the most recent shot with ail previous shots not displayed. By alternating the images on the display, and with processing by software 80 as described herein, system 10 can present the shooter these different views.

The user continues to take shots at target 90 and input to computer 70 each shot as just described, above. After each shot the user can store, tag and view the shot on the screen. The user can view all the shots on the screen at the same time (block 280) or may alternate the images so that only the most recent shot appears on computer 70's screen (block 290).

When the shooter has completed a shooting session, the data may be stored to any storage medium, such as a hard drive on computer 70, or to a flash drive, or uploaded to the Cloud, etc. (block 300). And, either in real-time or later, the user can review any one or any plurality of saved shots on the screen so that the user can self-assess or share with others to compare shooting ability or for shooting instruction and improvement (block 310).

Figure 13:
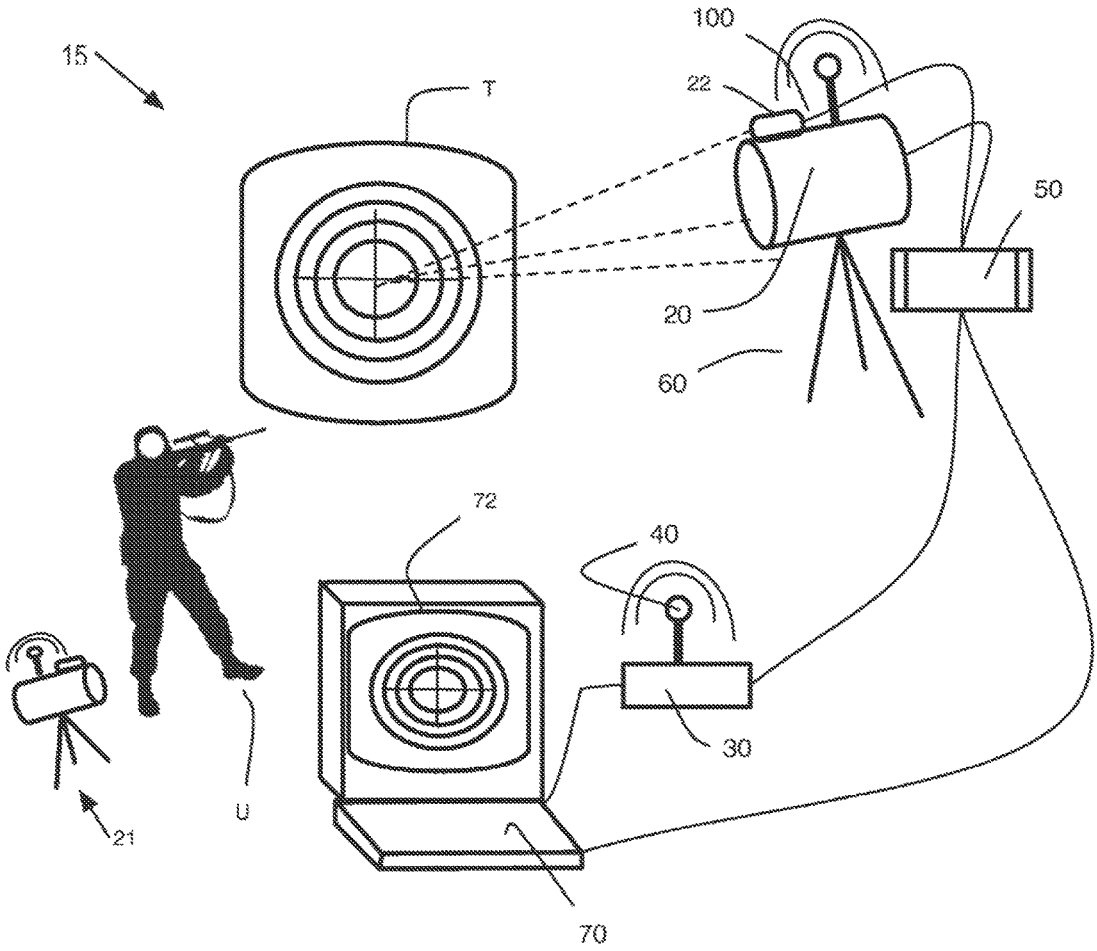
FIG. 13 is a schematic diagram of a second embodiment of the present invention.

FIG. 13 shows a second preferred embodiment of the present invention, system 15. Here, two cameras are used, first camera 20 and second camera 21. First camera 20 is focused on the target, as previously described. Second camera 21 is aimed at the shooter to record technique, body position, etc. Second camera 21 communicates with computer 70 by wired or wireless connections.

Compared to the embodiment discussed above with reference to FIGS. 9 and 10, the present invention contemplates a second camera adapted to capture a real-time image of the shooter taking a shot and correlating that image with the target image. It will be appreciated by those skilled in the art that this arrangement will be well suited for use as a certified training tool. For example, law enforcement agencies require periodic and regular time on the shooting range for all personnel that carry a sidearm and the present invention can be used to record the shooter as he or she shoots, and record the accuracy of multiple shots for certification compliance uses, for example.

Additionally, the image of the shooter, real-time, and correlated to the image of the shot on the target can further aid training by allowing the shooter to review the images to note body position, hand position, follow-through, and other aspects of firearm handling before, during, and after a shot fired to critique and improve technique.

For purposes of certification, the two images (shooter and target) would also include unique tagging of information (i.e. watermarked or clearly displayed and embedded) with user supplied information such as name, badge number, instructor name, time, place, location, ambient conditions, range name, type of firearm, ammunition, or any other data that is available at the time the shot was fired. If used at an outdoor range, the current weather conditions can be pulled from the Internet (i.e. weather.com) or otherwise inputted.

The camera or cameras can capture multiple views, such as a wind meter or chronograph on the range. This portion of foe image can be presented on the computer screen by clipping or cropping the image, or displaying the wind meter or chronograph readout in a separate window. Thus, a wind meter could be located downrange proximate the target, or a chronograph proximate to the shooter's position, with the software displaying the target on a first portion or window on the screen, and the wind meter and/or chronograph readouts in a separate window or second portion of the screen. This will be discussed further below.

This system can readily be adapted for use in other sports where a first camera could capture where the shot landed (such as golf) and a second camera could be focused on the player to capture body position and technique. Accordingly, this invention would work well in other sports including baseball, or tennis for example. Additionally, the present invention could be used as a training tool in a myriad of applications including place kicking for football, at the golf driving range, at the batting box, and other similar activities. Other improvements include keeping camera 20, battery 50, and router 40 proximate to target T, with relevant images and information broadcast back to computer 70.

The image on the computer can be alternated with a second or any other subsequent image. Thus, by alternating two or more images, such as a first image having a clean target image with a second image having a recent shot fired and the corresponding hole in the target, the viewer will see the recent shot "highlighted" visually on the screen. Further, the current shot can be shown in contest of all previous shots, by leaving the old shots on the frame with the blank target and then "blinking" the current shot. This can be accomplished by toggling between the previous captured frame with all shot shown (none digitally blanked out) and the current shot frame; the result will cause the current shot to appear to blink. Alternatively, the shot can be made to blink digitally as described elsewhere herein.

The software provides the ability to click on thumbnail images to review past shots. The system preferably comes in a packaged "kit" or "toolbox" that holds all necessary parts and those parts, with the exception of the software, stay down at the target location.

Other improvements include superimposing or attaching via metadata user-defined information about the shooter, e.g. badge number, instructor number, conditions of the shot, caliber, ammunition, load data, wind speed, shoot speed, etc., on each shot image. The MAC address of the computer or network card (or other unique hardware or software entered id value) can be used to tag each image from system 10 to prove what computer/system generated the image for training scenarios.

Providing a second camera 21 that records the shooter as he or she shoots can allow for later analysis of shooting form, mistakes, etc. Images and/or video from second camera 21 can be viewed side by side or simultaneously with the target on the screen, allowing each shot's position on the target to be correlated to the shooter's technique.

A booster coupled with the router enables data transfer to a computer at over 1000 yard distances. The camera can be equipped with infrared, lights to "see" at night and enable image recording on the computer. In fact, the infrared light source can be placed anywhere and need not be coupled physically to camera 20. The infrared light source need only illuminate the target and the reflected light will be read by camera 20. As those skilled in this art can appreciate, this ability can help recognize bullet holes on black targets, which can be nearly impossible to see at night and extremely difficult to see even under certain daylight conditions. The infrared light source combined with camera's 20 ability to capture the infrared spectrum along with computer 70 and software's 80 ability to transfer this data to a visible image on the computer display screen enables a shooter to better train and practice target shooting in low visibility conditions.

Further, the present invention contemplates use of multiple cameras at the same time at different distances. For example, camera #1 is at 100 yards, camera #2 is at 200 yards, camera #3 is at 1000 yards.

Software 80 either automatically crops of enables the user to crop an area of the camera's viewing range to use other devices such as a wind meter at the shooting and/or target location, so one camera can be used to monitor the target, and wind speed, temperature, etc. by the software knowing what to look at or crop out for each view.

System 15 contemplates interlacing a chronograph (or other devices) to log the bullet speed and tag it with each frame/image, which will be described in greater detail below. System 15 enables two or more shooters to shoot at one target and can then be used to assign which shooter is taking the shot. This reduces the need for new targets when there are multiple shooters. This can be further segmented by enabling the shooters to indicate on computer 70 a particular region of the target that they are using. For example, one shooter may shoot to the upper left of the target, while a second shooter may shoot to the lower right of the same target. Software 80 can then be informed via a cropping rectangle via software 80's user interface what portion of the view belongs to each respective shooter. Software 80 can further include the ability to upload, backup and store ail shooting profile data, images, etc., associated with each user in the "cloud" so that data is backed up and portable to any system at any location.

The software can be configured with a "tabbed" interface whereby multiple cameras and targets, e.g. 100 yards, 200 yards, 1000 yards, can be selected by clicking the tab key and it shows the correct camera.

"Plug and play" components can utilize autodiscovery of the camera on the network using IP scanning and or other universal plug and play to reduce set up time and complexity.

Other features include pairing/tagging cameras 20 and 21 so software 80 can recognize each camera next time i.e. using the hardware ID of the camera, or allowing hardwired cameras via network cable for shooting ranges and other similar places where a more permanent installation of the disclosed system is possible, and/or the greater reliability of a hardwired network vs. WiFi is desired. Software 80 can also be configured to password protect the data in the program so others can't see a particular user's data, which can be critical in some circumstances, e.g. for hand load or product development.

Figure 14:
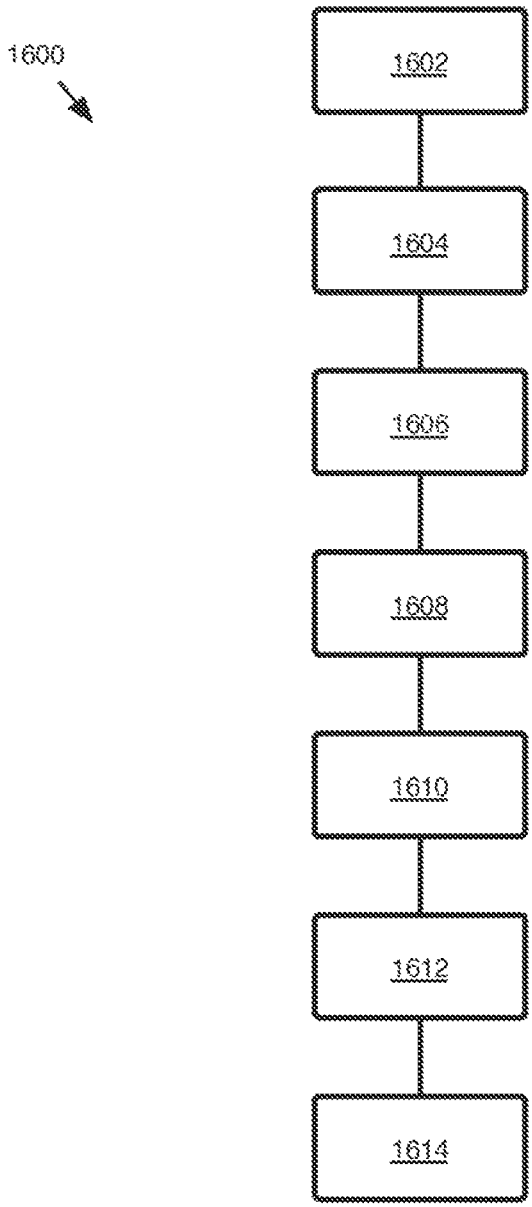
FIG. 14 illustrates one method according to a preferred embodiment of the present invention.

FIGS. 13 and 14 illustrate one contemplated preferred embodiment of the present invention includes a system 15 for improving shooting skill of a user having a conventional forearm configured to shoot ammunition at a physical target. System 15 includes a first camera 20, a second camera 21, both cameras configured to be in data communication with at least one computer 70 by means of a wireless or wired router 30. A conventional physical target T arranges at a predetermined distance from a user U (or shooter). Optionally, either or both cameras 20 and 21 include a light source, its configuration and use being well understood by those skilled in the art. First camera 20 optionally includes a laser 22 for sighting the camera to the target. A power source 50, including a data drive and or communication equipment for sending and receiving data signals to and from the computer, can be remotely positioned relative to the camera and relative to the computer to provide a more secure location for data storage, for example.

According to a method 1600 of using system 15, depicted to FIG. 14, the at least one computer 70 includes an executable software program. The executable software program is configured to capture a first image (step 1602) of the physical target, process a location of a first shot fired (step 1604) by capturing a second image from a camera 20 directed to the physical target T, displacing (step 1606) on a display 72 a first computer-processed representation of the first image, superimposing (step 1608) the location of foe first shot fired on the display 72 a second computer processed representation of the second image, and associating in step 1610 at least one data-characteristic w with the location of the first shot.

First camera 20 is further configured to capture at plurality of images and transmit data in step 1612 of the plurality of images to the at least one computer. First camera 20 may include a laser 22 or mounted to the first camera, to serve as an alignment device. The laser is configured to enable the user to align the camera relative to the physical target. Alternatively, instead of a laser any suitable alignment device as discussed above with reference to system 10 and alignment device 100 may be utilized. Additionally, first camera 20 includes a tripod 60 supporting the first camera, a light source (not shown in the drawing) coupled to the first camera.

A second camera 21 is configured to capture a plurality of images of the user U. Second camera 21 is configured to be in data communication with the at least one computer 70, wherein the executable software program is further configured to capture in step 1614 at least one user-image of the user shooting the firearm and correlate (step 1616) the at least one user-image with the location of a first shot feed by capturing a second image from a camera directed to the physical target.

Figure 15:
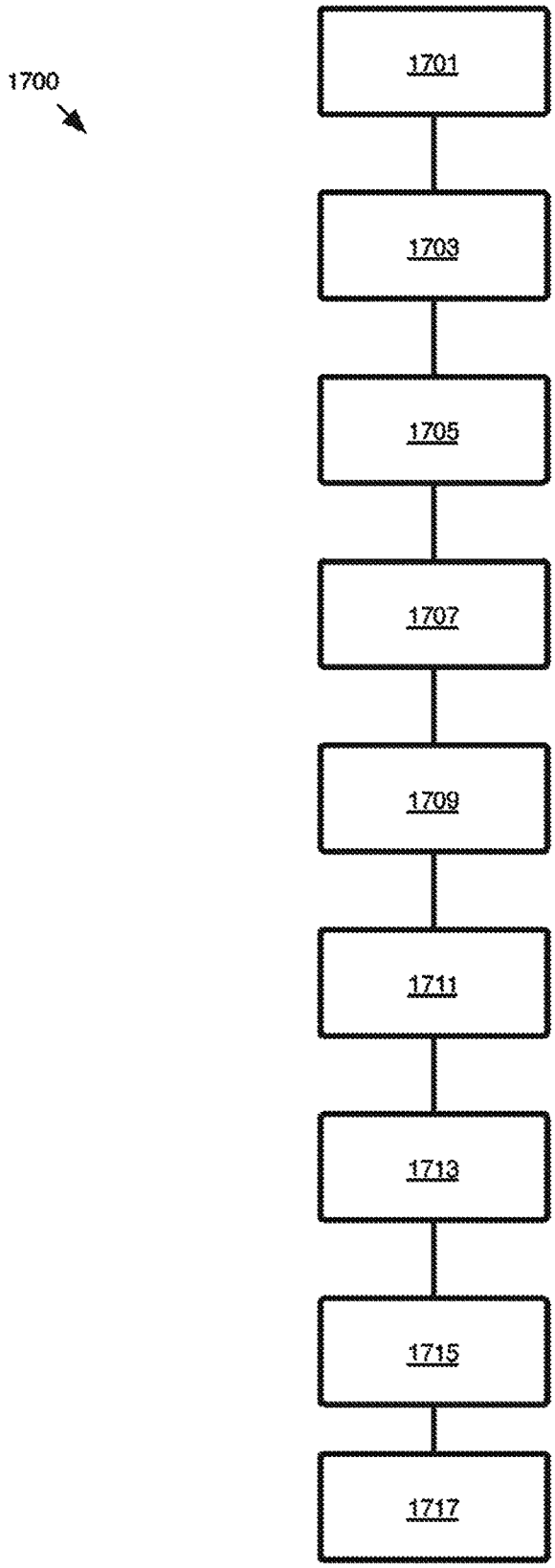
FIG. 15 illustrates another method according to another preferred embodiment of the present invention.

FIG. 15 shows another preferred method for use of a contemplated embodiment of the present invention. This method 1700 is a method for improving shooting skill of a user having a conventional firearm configured to shoot ammunition at a physical target. This method 1700 includes providing at least one computer in step 1701. The computer has an executable software program. The executable software program configured to capture a first image of the physical target, process a location of a first shot fired by capturing a second image from a camera directed to the physical target, display on a display a first computer processed representation of the first image, superimpose the location of the first shot fired on the display a second computer process representation of the second image, and associate at least one data-characteristic with the location of the first shot.

This method 1700 further includes the steps of: Providing (step 1703) a first camera configured to be in data communication with the executable software program on the at least one computer; using the first camera, capturing (step 1705) a first image of the physical target; representing (step 1707) the first image of the physical target on a display; using the first camera, capturing (step 1709) a second image of the physical target wherein the second image includes at least one physical representation of a shot fired; displaying (step 1711) the second image on the display; determining (step 1703) the location of at least one of a plurality of physical representations of a shot fired; associating (step 1715) at least one of a plurality of characteristics with the location of at least one of a plurality of physical representations of a shot fired; and configuring in step 1717 the computer to display a most recent shot by alternating a with a first or other image of previous-shots fired from the display by altering a first and second image on the display.

In this manner, the latest shot—or more particularly, the differences between the first image and second image—are highlighted by the oscillation of the images on the display. Much like how a sequence of cartoon images mimic movement when viewed in rapid succession, the present invention relies on the alternating images. Thus, the information captured by the two images that is constant, such as the target location, size, shape, markings, etc., while visible in both images, this information appears static to the viewer. However, the differences between the two images, for example a new hole in the target, will appear on the second image but not the first image. And the alternating nature of the two images will cause the viewer to see a "blinking" hole that represents the latest shot. In reality the hole is not blinking, but is rather being displayed in the second image and is absent in the first image, but because the two images are alternating on the display it is highlighted to the viewer. Alternatively, a digital manipulation technique as described above may be used to visually highlight each new shot.

Additionally, this method 1700 farther contemplates providing a second camera configured to capture a plurality of images of the user, the second camera further configured to be in data communication with the at least one computer and wherein the executable software program is further configured to capture at least one user-image of the user shooting the firearm and correlate the at least one user-image with the location of a first shot fired by capturing a second image from a camera directed to the physical target. At least one user-image of the user shooting the firearm is thus captured in step 1709 along with the second image of the shot taken, which is then correlated with the at least one user-image to the location of at least one of a plurality of physical representations of a shot fired.

Figure 17:
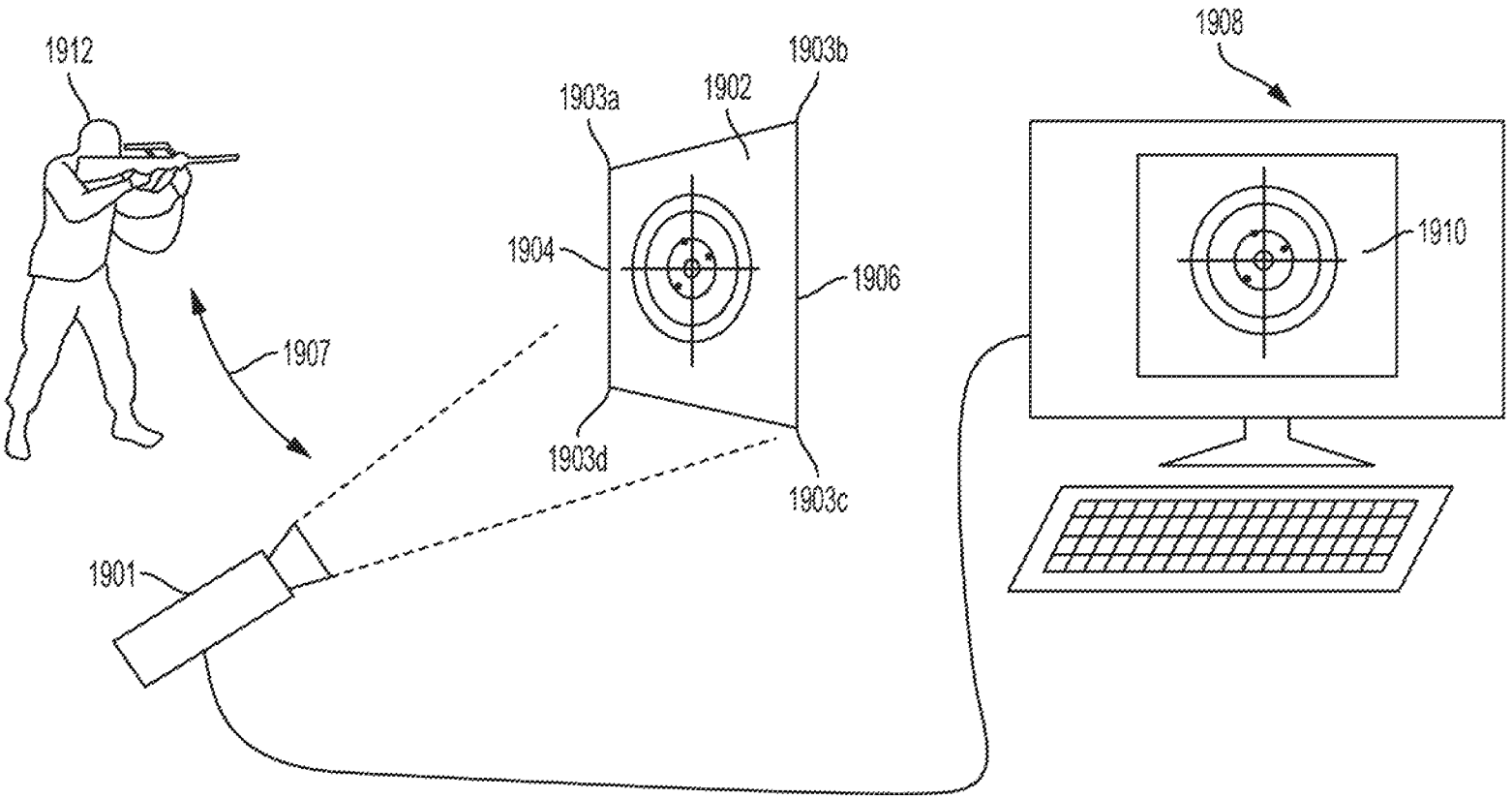
FIG. 17 is a schematic diagram of the preferred embodiment shown in FIG. 9 depicting skew correction functionality.

Referring now to FIG. 17, a setup for skew correction for system 10 is depicted. In many cases, camera 1901 (designated camera 20 in FIG. 9) is positioned off-axis from target 1902 by a certain off-set angle 1907. Target 1902 is typically positioned to be faced head-on by a shooter 1912. Placing camera 1901 head-on to target 1902, then, would result in camera 1901 being in the way of a direct line of fire for shooter 1912. This would result either in shooter 1912 accidentally shooting camera 1901, or requiring shooter 1912 to be off-axis from target 1902, which is not an ideal firing position in many training scenarios. Placement of camera 1901 off-axis from target 1902, however, results in camera 1901 capturing a target 1902 in a skewed perspective.

For example, where target 1902 is substantially square or rectangular, the off set angle 1907 results in target 1902 being captured as a trapezoid, with left target side 1904 being shorter than right target side 1906. This is undesirable in many circumstances, as it makes reading target 1902 and placed shots difficult. Software 80 can be implemented to correct this skew, and render target 1902 substantially in its original recilinear (or other appropriate shape) form. This is shown on display 1908, where target depiction 1910 is seen as substantially square. Software 80 can compute this when the four corners 1903*a*, 1903*b*, 1903*c* and 1903*d* of target 1902 are designated, allowing software 80 to digitally manipulate target depiction 1910 so that left target side 1904 is equal in length to right target side 1906. Such manipulation techniques are well-known in the digital image processing arts.

Furthermore, although FIG. 17 depicts correction of a target that is imaged with camera 1901 centered in a horizontal plane but skewed in a vertical plane with respect to the center of target 1902, it should be understood that camera 1901 could be placed off-center with respect to the horizontal plane, viz, placed in line with shooter 1912 but angled above or below shooter 1812, or skewed with respect to both the horizontal and vertical planes. In all cases, software 80 can be configured to correct for skew, keystoning, and/or parallax error so as to render target depiction 1910 in a correct rectilinear shape upon display 1908.

Figure 18A:
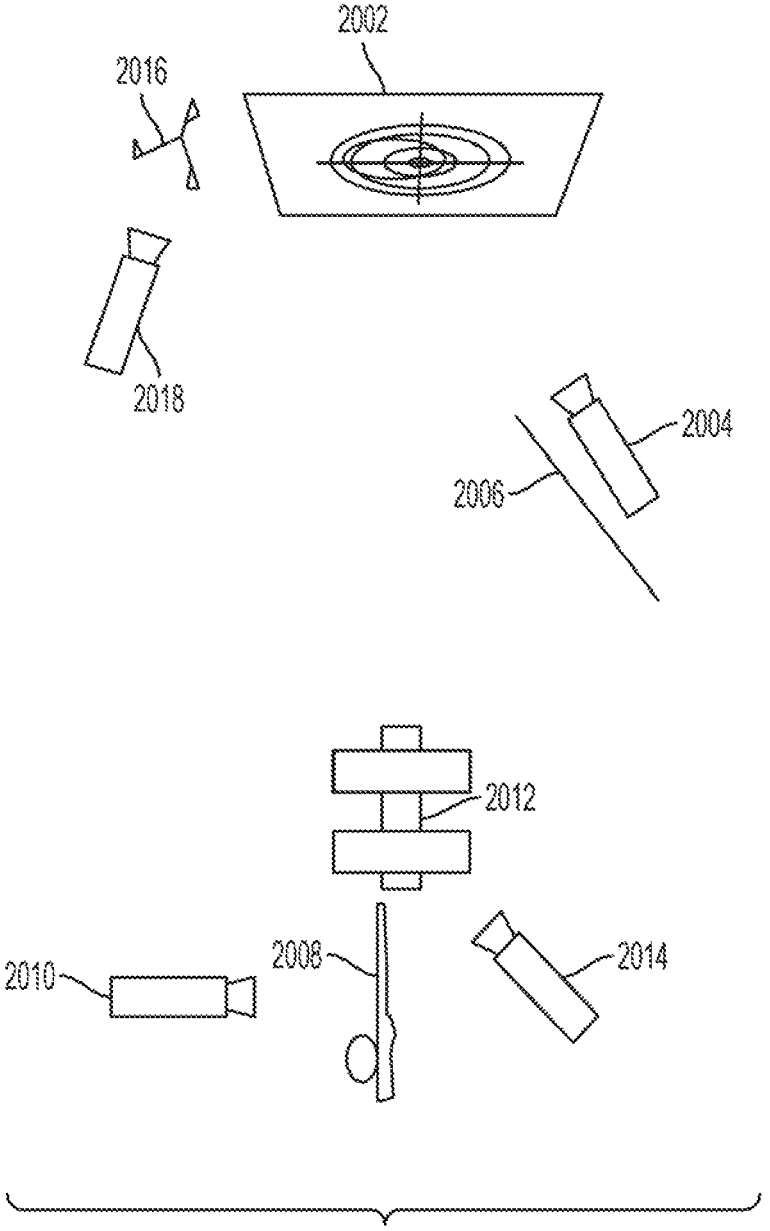
FIG. 18*a* is an overhead view of a preferred embodiment showing possible positions of multiple cameras for capturing the shooter, target, a wind speed indicator, and a chronograph.
Figure 18B:
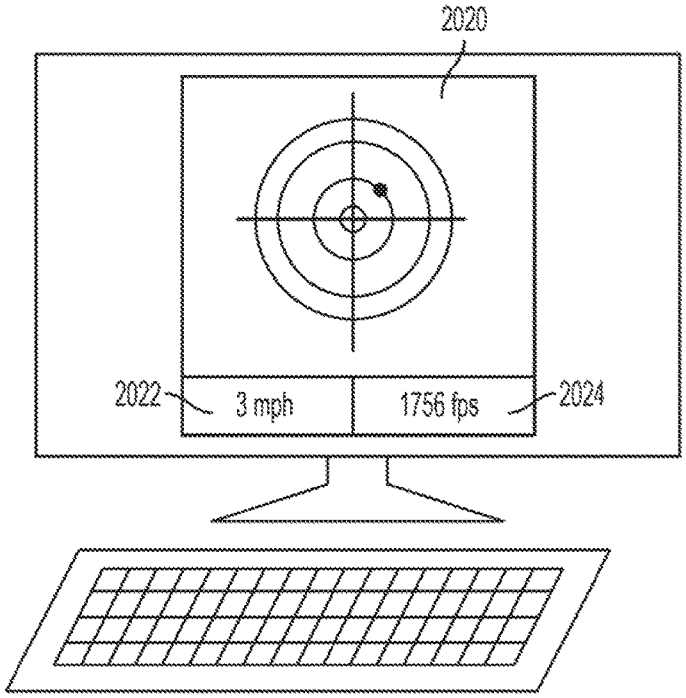
FIG. 18*b* is a front view of a display for a preferred embodiment showing overlays of wind speed and chronograph displays on top of a captured picture of the target.

FIGS. 18*a* and 18*b* demonstrate another embodiment of the disclosed invention where the system can be equipped with additional cameras for reading a wind meter and/or chronograph. The system on FIG. 18*a* includes target 2002, first camera 2004 which can be placed behind bullet resistant screen 2006, second camera 2010 which is directed to capture an image of shooter 2008, third camera 2014 which captures a read-out of chronograph 2012, and fourth camera 2018 which captures a read-out from wind meter 2016, placed proximate to target 2002. Each of first camera 2004, second camera 2010, third camera 2014 and fourth camera 2018 are of identical specifications as camera 20 described above, with first camera 2004 and second camera 2010 serving similar purposes as described above.

Chronograph 2012 is configured to provide the projectile velocity of each shot taken by shooter 2008. Such chronographs are well-known in the shooting industry, and typically provide a near-instantaneous read-out of projectile velocity in measurements such as feet per second, meters per second, miles per hour, kilometers per hour, or any other similarly suitable measurement unit. Wind meter 2016 likewise is well-known in the industry, and provides instantaneous readouts of wind velocity in either miles per hour, kilometers per hour, and/or knots per hour, and may include a wind direction readout. Although chronograph 2012 and wind meter 2016 are depicted in FIG. 18*a* as being located proximate to shooter 2008 and target 2002, respectively, it will be appreciated that these are suggested locations only, and not intended to be limiting. Chronograph 2012 and wind meter 2016 could be placed in other locations relative to short 2008 and target 2002 depending upon where a user wants to obtain measurements of projectile velocity and wind speed on the range, respectively. Still further, it should be appreciated that the system in FIG. 18*a* may be equipped with multiple chronographs 2012 and/or wind meters 2016 in various locations, each with their own additional camera(s), all feeding into software 80.

FIG. 18*b* depicts a possible display from software 80 that includes captured information from chronograph 2012 and wind meter 2016, captured by third camera 2014 and fourth camera 2018, respectively. The display shows target depiction 2020 in the upper half of the display, with a wind speed indicated in box 2022, occupying a lower left portion of the display, and projectile velocity in box 2024, occupying a lower right portion of the display. Software 80 thus combines inputs from third camera 2014 and fourth camera 2018 into the input from test camera 2004 by taking the relevant portions of third camera 2014 and fourth camera 2018 that include the respective display readouts from chronograph 2012 and wind meter 2016. Boxes 2022 and 2024 can be superimposed over target depiction 2020, can be windowed, or can be presented in separate boxes on a user interface. Where multiple chronographs 2012 and wind meters 2016 are implemented, such information may occupy additional portions of the display, or user may be able to cycle between readouts from different devices. It should also be understood that the information depicted in FIG. 18*b* is for example purposes only, for example, the read out of wind meter 2016 in box 2022 could include additional information such as wind direction, in addition to velocity. Moreover, the readouts of chronograph 2012 and wind meter 2016 can be converted to raw data, and the underlying image file of target depiction 2020 can be tagged with the raw data in the form of metadata, as is well known in the imaging arts.

It should further be appreciated by a person skilled in the relevant art that although the readouts of chronograph 2012 and wind meter 2016 are depicted as superimposed images from third camera 2014 and fourth camera 2018, in other implementations it may be possible for chronograph 2012 and/or wind meter 2016 to feed raw information directly to software 80 using a protocol that is known in the art, thereby eliminating the need for third camera 2014 and/or fourth camera 2018. In such an implementation, boxes 2022 and 2024 may instead be entirely generated by software 80 as displays of the relevant raw information directly received from chronograph 2012 and/or wind meter 2016. Information in boxes 2022 and 2024 is preferably automatically tagged to each captured shot image, along with possible recorded information described above with respect to systems 10 and 15.

Figure 19:
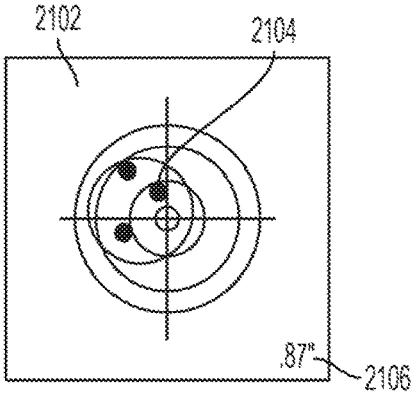
FIG. 19 is a representation of a display of a physical target, showing a shot grouping measurement as computed by the preferred embodiment system.

Turning to FIG. 19, another possible target depiction 2102 that software 80 could present is depicted. Target depiction 2102 includes a shot grouping 2104, along with a grouping measurement 2106, show in the lower right side of target depiction 2102. Where the size of the target is known, such data can be provided to software 80, which allows it compute the shot grouping measurement 2106 from the locations of tagged shots. Such data is then generated and rendered by software 80 in the form of grouping measurement 2106. Grouping measurement 2106 is depicted as a fraction of an inch, but other measurement units, such as metric in centimeters or millimeters, could be just as readily implemented. It should be appreciated that such measurement functionality of software 80 is preferably facilitated and/or made possible by the skew correction functionality described above with respect to FIGS. 18*a* and 18*b*. Such correction allows for a fairly scale-accurate target depiction 2102, which in turn allows for software 80 to compute grouping measurement 2106. As with other data, grouping measurement 2106 can be tagged to each captured shot image.

A variation on the capability of software 80 to determine shot grouping measurement is a mode to assist with sighting in a firearm. Software 80 is preferably configured to accept an input from the user regarding the type of scope, e.g. MOA or MILS, along with any other necessary information such as range to target, and designation of the target center. The user can then take a shot and mark it as described above, and software 80 can then automatically determine the shot distance from the designated target center using the same techniques for determining grouping measurement 2106. From this information, coupled with the type of scope specified by user and range to target, software 80 can compute a recommended scope adjustment in terms of windage and elevation clicks, or other units appropriate to the scope type, which will adjust the scope so that the firearm approximately hits the target center.

Figure 20:
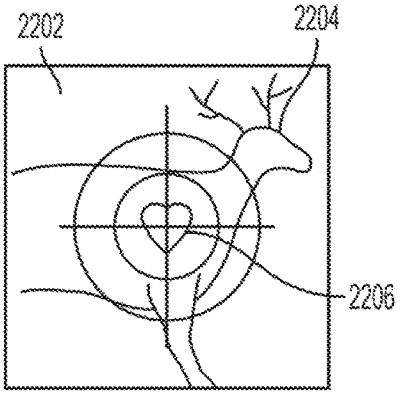
FIG. 20 is a representation of a display of a physical target presented by the preferred embodiment system, with an animal overlay, showing a silhouette of the animal's viral organs.

Likewise, FIG. 20 shows yet another possible display overlay that software 80 could generate. In this case target depiction 2202 includes an overlay 2204 of a game silhouette, particularly highlighting a vital organ region 2206. The game silhouette depicted is that of an antlered animal such as a deer or elk, but it will be understood that the silhouette could depict any animal. This depiction can be of particular use to hunters that use the disclosed system. While physical targets are commercially available that mimic the silhouette and vital organ region of various types of game, software 80 can provide a digitally generated representation and place overlay 2204 over any target type, including a simple blank sheet of paper used as a target.

By creating the silhouette as a digital overlay 2204, the flexibility of the system for hunters is greatly enhanced. The size of game and their vitals can vary greatly depending upon the range from the shooter to the game. By allowing the silhouette to be digitally overlaid, system 80 can also allow the relative size of the silhouette of overlay 2204 to be scaled to represent different ranges, with a smaller overlay 2204 and correspondingly smaller vital organ region 2206 representing a greater distance to the game. By combining the shot group measurement functionality described above with respect to FIG. 19, the disclosed system can become a useful tool for hunters to improve their marksmanship in anticipation for hunting.

It should be appreciated that the ability of software 80 to provide an overlay of a game silhouette is but one possible implementation of overlay functionality, and that software 80 could be configured to overlay any number of different generated graphics. Combined with the ability to track and measure shots, software 80 could be configured to enable a game mode, where shots are scored for accuracy or grouping, and a user is challenged to improve scores. Other possible game modes could include alternating between multiple shooters, allowing for simulated hunting competitions or direct comparison of shot accuracy via overlays of other users' shot placements. Still further, software 80 can overlay a target grid on any sort of physical target, with the grid possibly being calibrated to an appropriate size for scope adjustments, for example, based upon the range from shooter to target.

Further, in other embodiments, software 80 can be configured to automate various functions described herein. For example, software 80 could use a detection algorithm to determine the location of each shot taken automatically, without the need for the user to specifically tag or mark each shot. Capture of images can be automated by any number of automatic triggering mechanisms, e.g. audio detection of the shot, physical detection by the back stop, visual triggering by chronograph or similar mechanism, detection by high speed camera, etc. Range to target can even be determined automatically by attaching a range, finding mechanism to system 10 or 15 in lieu of the user manually entering the range to target.

Finally, it will be appreciated by those skilled in the art that the various components of the present invention may be physically arranged in many different layouts. The components need not be in physical proximity to each other, nor do they require a wired connection. The computer am be remotely located and in data communication with the camera by standard wifi, by a booster or router, or by other well-understood means. Obviously, the camera needs to be able to 'see' the target, and the infrared light source must be close enough to the target to effectively illuminate it, but again, these components need not be coupled to each other.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A system for improving shooting skills of a user shooting at a physical target, the system comprising:

a first camera;

an alignment device attached to the first camera, the alignment device configured to enable the user to align the first camera relative to the physical target; and a computer having an executable software program, the computer comprising a processing unit, a system memory, at least one input device and at least one output device, wherein the processing unit, the system memory, the at least one input device and the at least one output device communicate through a bus, and the system memory is configured to store the executable software program;

the executable software program configured to capture a first image of the physical target from the first camera directed to the physical target before any shots are fired;

capture a second image of the physical target from the first-camera, the second image being captured after a shot is fired at the physical target;

display on a display a computer-processed representation of the first image and repeatably alternating the first image with the second image whereby the shot fired at the physical target appears to blink on the display; and allow the user to associate at least one data-characteristic with the location of the shot on the physical target.

2. The system of claim 1 further comprising a tripod supporting the first camera.

3. The system of claim 1 further comprising a light source coupled to the first camera.

4. The system of claim 1 further comprising a wireless router configured to enable the computer to send and receive data signals to and from the first camera.

5. The system of claim 1 further comprising:

a second camera configured to capture a plurality of user-images of the user, each of the plurality of user-images being captured after the shot is fired at the physical target, the second camera further configured to be in data communication with the computer and wherein the plurality of user-images comprises at least one user-image of the user; and the executable software program is further configured to correlate at least one of the plurality of user-images of the user with the location of the shot fired as represented in the second image from the first camera directed to the physical target.

6. The system of claim 1 wherein the executable software program further comprises:

configuring the display to digitally alternate screen views between two or more images to give the viewer new information by rapidly altering a more recent image with a previous image.

7. A method for improving shooting skills of a user having a conventional firearm configured to shoot ammunition at a physical target, the method comprising:

selecting a computer and at least a first camera in data communication with the computer, the first camera comprised of an alignment device mounted to the first camera, the alignment device configured to enable the user to align the first camera relative to the physical target;

capturing a first image by the first camera of the physical target before any shots are fired at the physical target;

transmitting the first image from the first camera to the computer;

placing a first shot by the user on the physical target;

tagging the location of the first shot;

capturing a second image by the first camera of the physical target with the first shot;

placing a second shot by the user on the physical target;

tagging the location of the second shot;

capturing a third image by the first camera of the physical target with the first shot and second shot;

using the first image, second image and third image by the computer to generate a depiction of the target where the second shot is visually highlighted;

displaying on a display coupled to the computer a computer-processed representation of the first image and repeatably alternating the first image with the second image whereby the location of the first shot fired at the physical target appears to blink on the display.

8. The method of claim 7 further comprising:

selecting a second camera configured to capture a plurality of images of the user, the second camera further configured to be in data communication with the computer and wherein the executable software program is further configured to correlate at least one user-image with either the location of the first shot or the second shot.

9. A system for improving shooting skills of a user shooting at a physical target, the system comprising:

a first camera, the first camera including an alignment device to enable the user to align the camera relative to the physical target; and a computer with a processing unit, a system memory, at least one input device and at least one display wherein each the processing unit, system memory, the at least one input device and the at least one output device communicate directly or indirectly through a bus;

wherein:

the first camera is in data communication with the computer, the system memory is configured to store the executable software program, and the executable software program is configured to:

capture a first image of the physical target from the first camera before any shots are fired;

capture a second image of the physical target from the first camera, the second image being captured after a shot is fired at the physical target; and display on a display a computer-processed representation of the first image and repeatably alternating the first image with the second image whereby the shot fired at the physical target appears to blink on the display.

10. The system of claim 9, wherein the second image is captured after at least one other shot is fired at the physical target, and the executable software program is configured to use the first image and second image to remove the at least one other shot so that the shot appears by itself.

11. The system of claim 9, wherein the first camera is positioned off-axis from the physical target resulting in the first and second images depicting the physical target in a skewed perspective, and the executable software program is configured to adjust the computer-processed representation of the physical target to a rectilinear shape.

12. The system of claim 10, wherein the physical target includes a group of shots, and the executable software program is configured to calculate the size of the group of shots.

13. The system of claim 10, wherein the executable software program is configured to accept as input a type of scope and a location of a desired target point, and can calculate adjustments for the scope based on comparing the location of the desired target point with a location of the shot to bring the scope into alignment with the desired target point.

14. The system of claim 9, wherein the executable software program is configured to display an overlay upon the computer-processed representation of the physical target.

15. The system of claim 14, wherein the overlay includes information from the user that the user inputs using the at least one input device, the information specific to the second image and the shot.

16. The system of claim 9, wherein the input device is a touch screen.

17. The system of claim 9, wherein the user can use the at least one input device to tag the shot with information including the location of the shot on the physical target.

18. The system of claim 17, further comprising a second camera configured to capture images of the user, and the executable software program is configured to capture an image of the user with the second camera when the second image of the physical target is captured.

* * * * *